US005822831A

United States Patent [19]

Cheng

[11] Patent Number: 5,822,831

[45] Date of Patent: Oct. 20, 1998

[54] POSITIONING DEVICE FOR COLLAPSIBLE LUGGAGE TROLLEYS

[76] Inventor: Shih-Min Cheng, No. 1-2 Lane 132, Lin-Jiang Road, Da-Jia Town, Taichung Hsien, Taiwan

[21] Appl. No.: 931,353

[22] Filed: Sep. 16, 1997

[51] Int. Cl.[6] ..... A47B 95/02

[52] U.S. Cl. ..... 16/115

[58] Field of Search ..... 16/115; 190/18 A, 190/115, 39, 117; 280/37, 47.315, 655, 655.1, 47.31; 403/109, 377, 350

[56] References Cited

U.S. PATENT DOCUMENTS

| | | | |
|---|---|---|---|
| 5,379,486 | 1/1995 | Wang | 16/115 |
| 5,459,908 | 10/1995 | Chen | 16/115 |
| 5,620,070 | 4/1997 | Wang | 16/115 |

*Primary Examiner*—Chuck Mah
*Attorney, Agent, or Firm*—Rosenberg, Klein & Bilker

[57] ABSTRACT

A positioning device is provided for a luggage trolley having a pair of outer tubes, a pair of inner tubes respectively, telescopically received in the outer tubes, and a handle connected to upper ends of the inner tubes. The positioning device includes a connecting rod pivotably mounted in each inner tube, a manually operable actuating member mounted to the handle and connected to an upper end of each connecting rod to urge pivotal movement of the connecting rod, and an engaging member mounted in each inner tube. Each engaging member is pivoted to be disengaged from an associated engaging hole of the associated outer tube when the actuating member is actuated to allow vertical movement of the inner tubes in the outer tubes. Each engaging member is biased to selectively engage with one of the engaging holes when the actuating member is released so as to position the inner tubes in the outer tubes.

6 Claims, 9 Drawing Sheets

POSITIONING DEVICE FOR COLLAPSIBLE LUGGAGE TROLLEYS

BACKGROUND OF THE INVENTION

1. Field of the Invention

The present invention relates to an improved positioning device for collapsible luggage trolleys.

2. Description of the Related Art

A typical collapsible luggage trolley includes a pair of outer tubes secured to a side of the luggage trolley, a pair of inner tubes respectively, telescopically received in the outer tubes, an operative handle connected to the inner tubes for manual operation, and a positioning means mounted between the inner tubes and the outer tubes to provide the required positioning effect of the inner tubes. FIG. 8 of the drawings illustrates a prior art positioning device in which a torsion spring 81 is mounted inside the inner tube 80 and includes a first end secured to the inner tube 80 and a second end with a block 82 securely attached thereto. The block 82 includes a dome 820 releasably received in one of a number of engaging holes 91 which are vertically spaced on a periphery of the outer tube 90. The user may, e.g., lift the operative handle to forcibly disengage the dome 820 of the block 82 from the engaging hole 91 until the dome 820 slides into an upper engaging hole 91 under the action of the spring 81. A drawback of this arrangement is that the inner tube 80 is often inadvertently, unexpectedly actuated as the positioning effect provided by the dome 820 is poor.

FIG. 9 of the drawings illustrates another prior art positioning device in which a positioning tube 50 is securely provided between the inner tube 30 and the outer tube 40. The positioning tube 50 includes an inner threading for threadedly engaging with the inner tube 30 and a bottom plate 52 which provides a support for a block 62. A press rod 60 is extended through the inner tube 30 and includes an actuating piece 61 attached to a lower end thereof. When the press tube 60 is manually pressed downwardly, the block 62 is moved inwardly as a slant surface 610 of the actuating piece 61 slides along and thus exert a force on a slant surface 620 of the block 62. Accordingly, an engaging portion 63 of the block 62 disengages from an engaging hole 41 of the outer tube 40, thereby allowing the inner tube 30 to be moved, e.g., upwardly until the engaging portion 63 of the block 62 engages with another engaging hole 41 of the outer tube 40 under the action of a spring 70 provided between the positioning tube 50 and the block 62. Although this arrangement may provide a more reliable positioning effect, it still has several drawbacks. First, the overall structure is too complicated and thus is inconvenient and time-consuming in assembly and causes an increase in the cost. In addition, the user must apply a relatively large force to overcome the frictional resistance between the slant surfaces 610 and 620 to move the block 62. Furthermore, the actuating piece 61 tends to be disengaged from the press rod 60 after a term of use as the former is generally adhered to the latter by glue. The present invention is intended to provide an improved positioning device which mitigates and/or obviates the above problems.

SUMMARY OF THE INVENTION

A positioning device is provided for a luggage trolley of the type having a pair of outer tubes, a pair of inner tubes respectively, telescopically received in the outer tubes, and a handle means connected to upper ends of the inner tubes, each said outer tube including a plurality of vertically spaced engaging holes. The positioning device comprises a connecting rod pivotably mounted in each inner tube and having an upper end and a lower end, a manually operable actuating means mounted to the handle means and connected to the upper end of each connecting rod to urge pivotal movement of the connecting rod, and an engaging means mounted in each inner tube and securely connected to the lower end of an associated connecting rod to pivot therewith. Each engaging means includes an engaging member releasably, selectively engaged in one of the engaging holes of an associated outer tube, and means is provided for biasing each engaging member to engage with one of the engaging holes of the associated outer tube.

Each engaging member is pivoted to be disengaged from an associated engaging hole of the associated outer tube when the actuating means is actuated to allow vertical movement of the inner tubes in the outer tubes. Each engaging member is biased to selectively engage with one of the engaging holes when the actuating means is released so as to position the inner tubes in the outer tubes.

Preferably, a press button is mounted to the handle means to manually actuate the actuating means. In addition, a torsion spring mounted to the upper end of each connecting rod for returning the connecting rod and the actuating means.

Preferably, the engaging member includes a dome releasably, selectively engaged with one of the engaging holes. The engaging device may include two half pieces for containing the engaging member therein, and wherein one of the half pieces has a slot through which the dome extends. The other one of the half pieces may include a receptacle defined therein for receiving the biasing means and an end of the engaging member which bears against the biasing means.

Other objects, advantages, and novel features of the invention will become more apparent from the following detailed description when taken in conjunction with the accompanying drawings.

DESCRIPTION OF THE PREFERRED EMBODIMENTS

Figure 1:
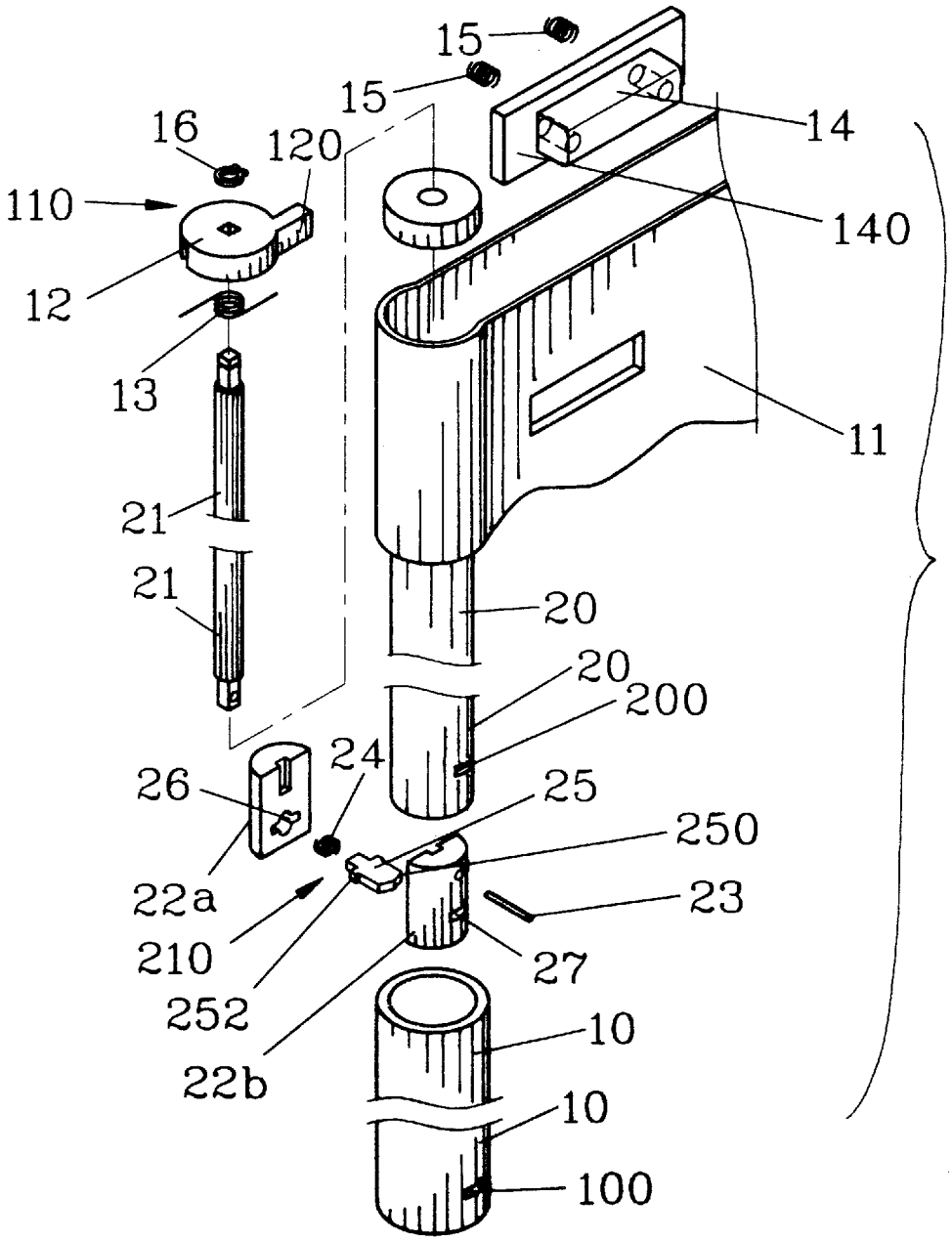
FIG. 1 is an exploded perspective view illustrating a portion of a positioning device for a collapsible luggage trolley in accordance with the present invention.

Referring to FIGS. 1 to 7 and initially to FIGS. 1 to 4, a collapsible luggage trolley generally includes a pair of outer tubes 10 securely attached to a side thereof, a pair of inner tubes 20 respectively, telescopically received in the outer tubes 10, and a handle means 11 connected to upper ends of the inner tubes 20. Each outer tube 10 includes a number of vertically spaced engaging holes 100. It is appreciated that the luggage trolley itself is conventional and thus omitted for clarity, while only a half portion of the overall assembly (including the outer tubes 10, the inner tubes 20, and the handle means 11) is shown, the other half portion being a mirror image.

A positioning device in accordance with the present invention includes an actuating means 110 which can be manually operated, an engaging means 210 mounted in the respective inner tube 20, and a connecting rod 21 interconnected between the actuating means 110 and the engaging means 210.

Figure 4:
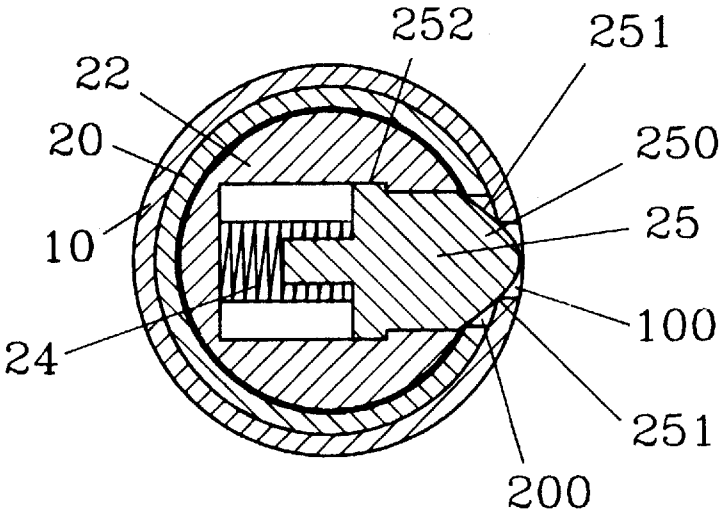
FIG. 4 is a sectional view taken along line 4—4 in FIG. 3.

The engaging means 210 is secured to the lower end of the connecting rod 21 to pivot therewith and includes two half pieces 22*a*, 22*b* which are secured together by a pin 23. One of the half pieces, e.g., the half piece 22*a* includes a receptacle 26 for receiving a spring 24 therein, while the other half piece 22*b* includes a slot 27 defined in a periphery thereof. An engaging member 25 is mounted in the engaging means 210 and includes a first end received in the receptacle 26 of the half piece 22*a* and bearing against the spring 24 and a second end which may partially extend beyond the slot 27 of the half piece 22*b* under the action of the spring 24. As shown in FIG. 4, the engaging member 25 includes a dome 250 having two side portion 251 which bear against a wall defining the engaging hole 100 of the outer tube 10 when in a positioned status. Preferably, the engaging member 25 includes two protrusions 252 (FIGS. 1 and 4) respectively formed on two lateral sides thereof to prevent from disengagement of the engaging member 25 from the engaging means 210.

The actuating means 110 includes a pivotal member 12 which is securely connected to an upper end of the connecting rod 21 (e.g., by a C-clip 16) to pivot therewith, and a returning means, e.g., a torsion spring 13 is provided to the upper end of the connecting rod 21 to return the connecting rod 21 as well as the pivotal member 12 to their initial positions. The actuating means 110 may include a press button means 14 mounted on the handle means 11, the press button 14 having an operative section 140 which is connected to an extension 120 of the pivotal member 12 such that the pivotal member 12 as well as the connecting rod 21 are pivoted when the press button 14 is pressed. In this embodiment, the handle means 11 includes a slot (not labeled) through which the press button 14 extends for manual operation.

Figure 2:
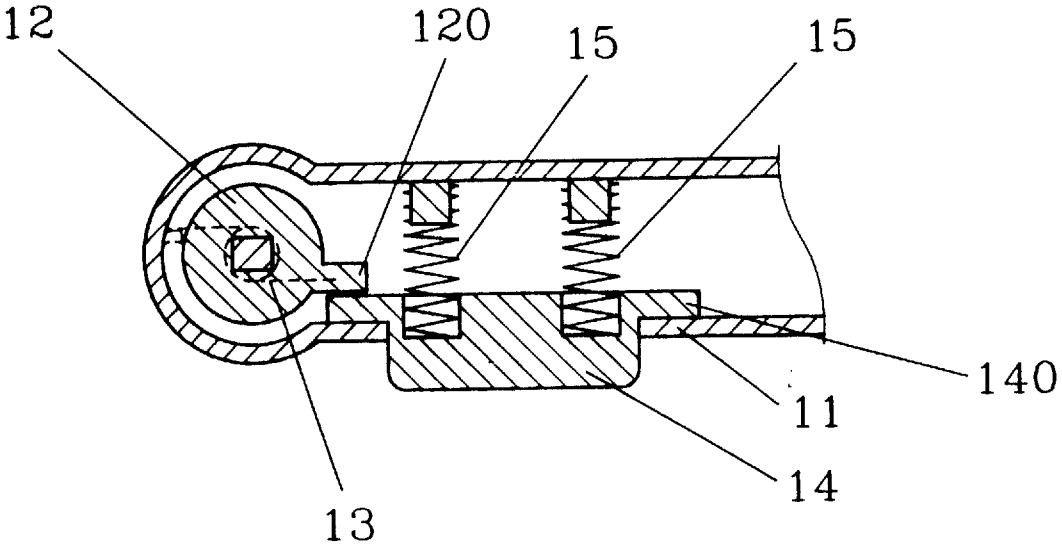
FIG. 2 a partial sectional view, taken along a horizontal plane, of the positioning device.
Figure 3:
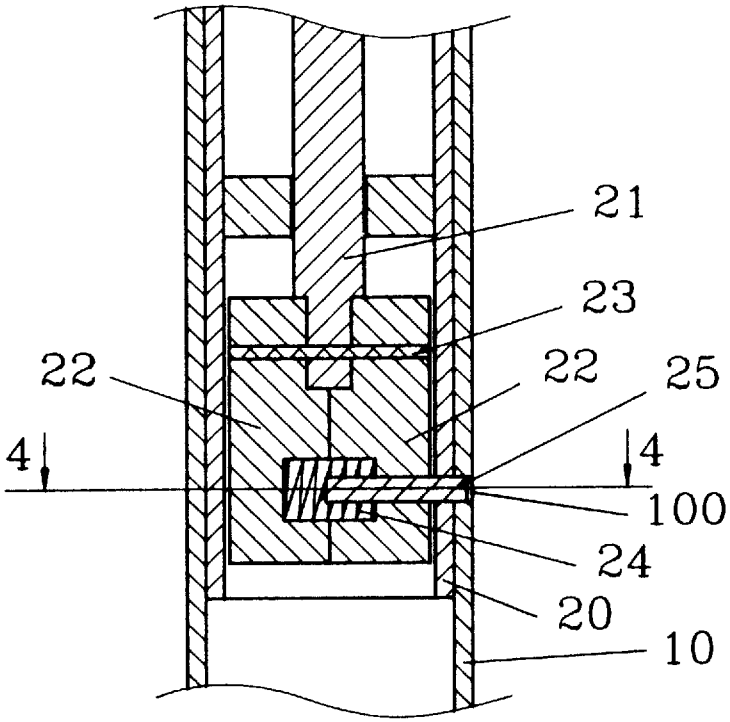
FIG. 3 a partial sectional view, taken along a vertical plane, of the positioning device.

In assembly, referring to FIGS. 1 to 3, the spring 24 is inserted into the receptacle 26 and the first end of the engaging member 25 is then inserted into the receptacle 26. Then, the half pieces 22*a*, 22*b* are jointed together in a manner that the dome 250 of the engaging member 25 is extended through the slot 27. Thereafter, the whole engaging means 210 is secured to the lower end of the connecting rod 21 by the pin 23, and the combination of the engaging means 210 and the lower end of the connecting rod 21 is inserted into a lower portion of the inner tube 20. After that, the returning spring 13 is mounted to the upper end of the connecting rod 21, and the pivotal member 12 is secured to the upper end of the connecting rod 21 and then positioned by the C-clip 16. Then, the press button 14 is mounted in the handle means 11 in a manner that the operative section 140 engages with the extension of the pivotal member 12. Thereafter, the inner tube 20 is inserted into the outer tube 10 until the dome 250 is extended into one of the engaging holes 100 while the side portions 251 of the dome 250 bear against the wall defining the engaging hole 100.

Figure 5:
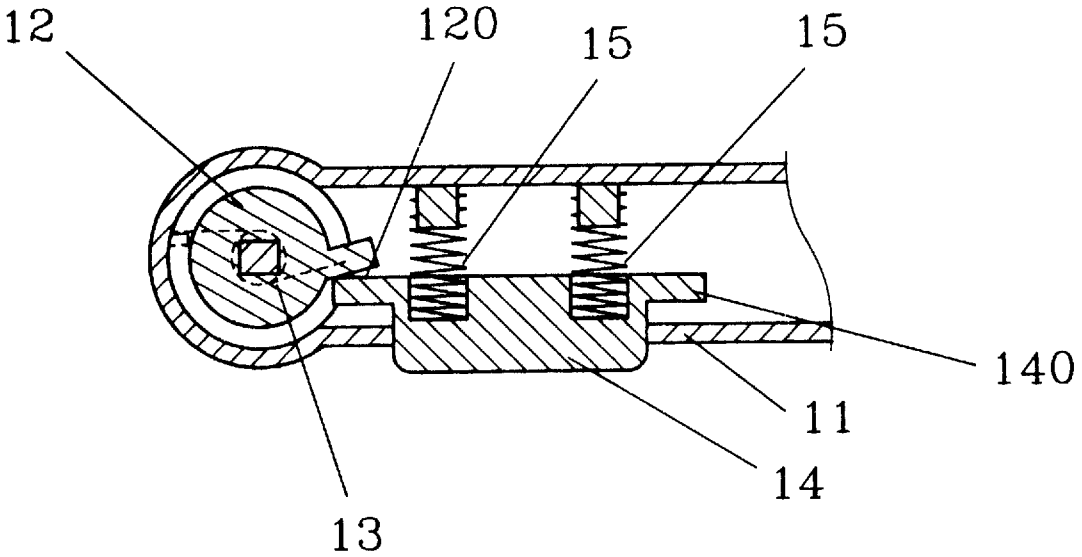
FIG. 5 is a view similar to FIG. 2, illustrating operation of the positioning device.
Figure 6:
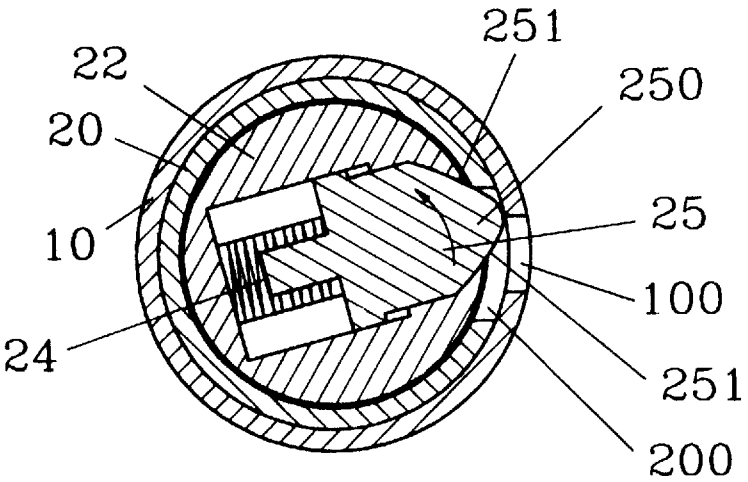
FIG. 6 is a view similar to FIG. 4, illustrating operation of the positioning device.

In use, referring to FIG. 5, the press button 14 is pressed inwardly to cause pivotal movement of the pivotal member 12 and the connecting rod 21, which, in turn, causes pivotal movement of the engaging means 210. As shown in FIG. 6, the engaging member 25 also pivots such that the dome 25 is disengaged from the engaging hole 100 of the outer tube 10, thereby allowing the inner tube 20 to slide vertically in the outer tube 10 until the dome 250 is received in another engaging hole 100 of the outer tube 10 under the action of the spring 24 (the press button 14 is released after disengagement of the dome 250 from the outer tube 10). As shown in FIG. 5, a pair of springs 15 may be mounted in the handle means 11 to return the press button 14. It is appreciated that the dome 250 allows the engaging member 25 to be disengaged from the outer tube 10 in a simpler, easier way. Although the described operation and the drawing illustrated includes only one inner tube and one outer tube, it is appreciated that the two inner tubes are actuated synchronously.

Figure 7:
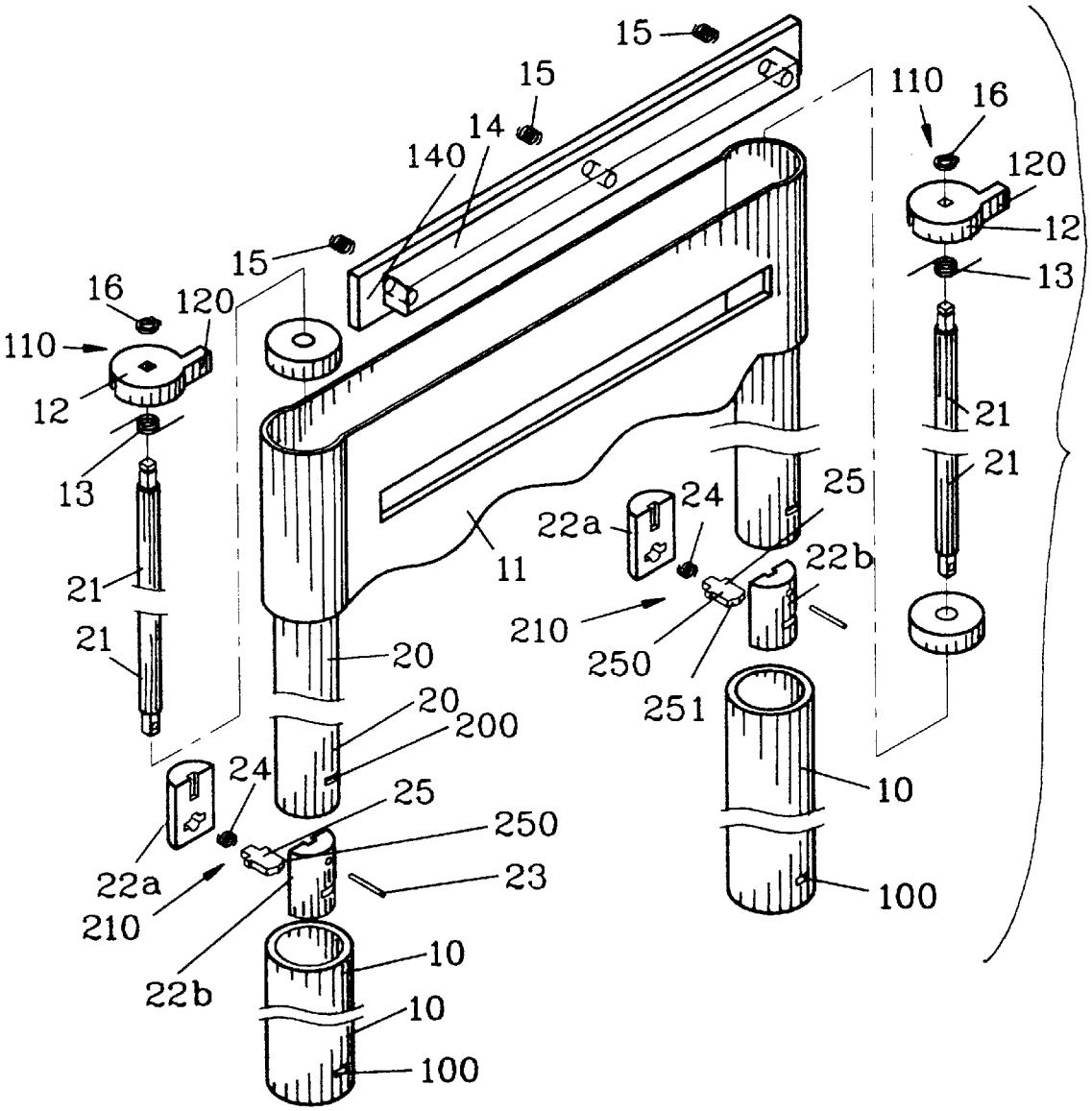
FIG. 7 is a partial exploded perspective view illustrating a modified embodiment of the positioning device in accordance with the present invention.
Figure 8:
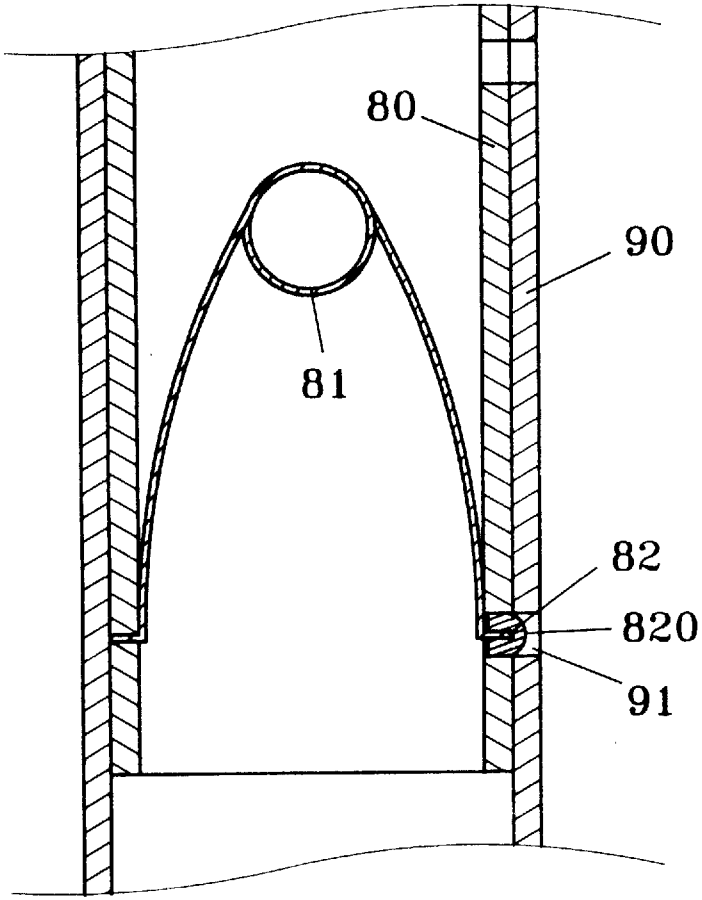
FIG.8 PRIOR ART
FIG. 8 is a schematic sectional view illustrating a portion of a prior art collapsible luggage trolley.
Figure 9:
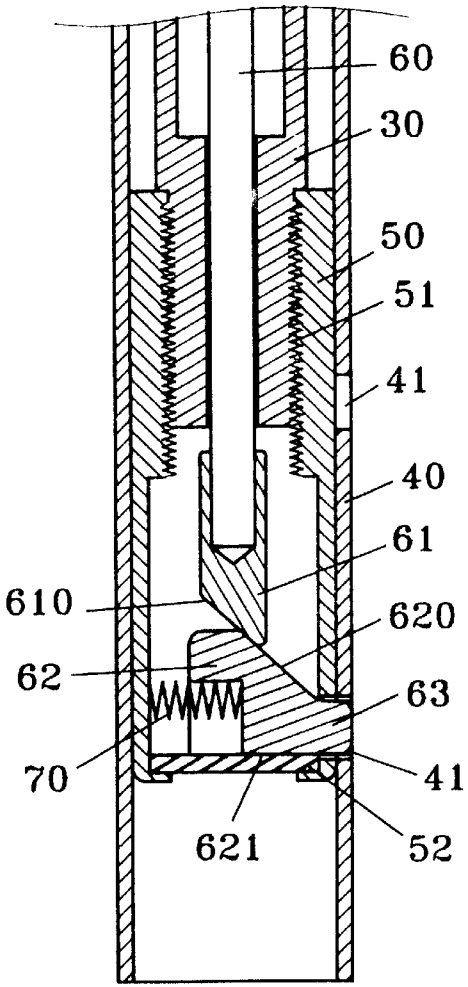
FIG. 9 PRIOR ART
FIG. 9 is a schematic sectional view illustrating a portion of another prior art collapsible luggage trolley.

FIG. 7 illustrates a modified embodiment of the press button 14 in which the press button 14 extends along almost an overall length of the handle means 11, instead of two separate press buttons 14 (only one is shown) in the embodiment shown in FIG. 1, and the two inner tubes 20 are synchronously operated by the single press button 14.

According to the above description, it is appreciated that the positioning device in accordance with the present invention may be reliably, effectively operated due to provision of the domes 250. In addition, the press button 14 mounted to the handle means can be easily, conveniently operated.

Although the invention has been explained in relation to its preferred embodiment, it is to be understood that many other possible modifications and variations can be made without departing from the spirit and scope of the invention as hereinafter claimed.

What is claimed is:

1. A positioning device for a luggage trolley of the type having a pair of outer tubes, a pair of inner tubes respectively, telescopically received in the outer tubes, and a handle means connected to upper ends of the inner tubes, each said outer tube including a plurality of vertically spaced engaging holes, the positioning device comprising:

a connecting rod pivotably mounted in each said inner tube and having an upper end and a lower end;

a manually operable actuating means mounted to the handle means and connected to said upper end of each said connecting rod to urge pivotal movement of said connecting rod;

an engaging means mounted in each said inner tube and securely connected to said lower end of an associated said connecting rod to pivot therewith, each said engaging means including an engaging member releasably, selectively engaged in one of the engaging holes of an associated said outer tube; and means for biasing each said engaging member to engage with one of the engaging holes of the associated outer tube;

wherein each said engaging member is pivoted to be disengaged from an associated engaging hole of the associated outer tube when the actuating means is actuated to allow vertical movement of the inner tubes in the outer tubes, and each said engaging member is biased to selectively engage with one of the engaging holes when the actuating means is released so as to position the inner tubes in the outer tubes.

2. The positioning device according to claim 1, further comprising a press button mounted to the handle means to manually actuate the actuating means.

3. The positioning device according to claim 2, further comprising a torsion spring mounted to the upper end of each said connecting rod for returning the connecting rod and the actuating means.

4. The positioning device according to claim 1, wherein the engaging member includes a dome releasably, selectively engaged with one of the engaging holes.

5. The positioning device according to claim 4, wherein the engaging means includes two half pieces for containing the engaging member therein, and wherein one of the half pieces has a slot through which the dome extends.

6. The positioning device according to claim 5, wherein the other one of the half pieces includes a receptacle defined therein for receiving the biasing means and an end of the engaging member which bears against the biasing means.

* * * * *